US007588070B2

(12) United States Patent
Smetan

(10) Patent No.: US 7,588,070 B2
(45) Date of Patent: Sep. 15, 2009

(54) PRODUCTION LINE AND METHOD FOR THE PRODUCTION OF CAST PARTS, FROM A METALLIC MELT, IN PARTICULAR A LIGHT MOLTEN METAL, WHICH TAKES PLACE IN A CONTINUOUS CYCLE

(75) Inventor: Herbert Smetan, Siersburg (DE)

(73) Assignee: Hydro Aluminium Alucast GmbH, Dillingen (DE)

( * ) Notice: Subject to any disclaimer, the term of this patent is extended or adjusted under 35 U.S.C. 154(b) by 0 days.

(21) Appl. No.: 10/562,959

(22) PCT Filed: Dec. 17, 2004

(86) PCT No.: PCT/EP2004/014388

§ 371 (c)(1),
(2), (4) Date: Oct. 12, 2006

(87) PCT Pub. No.: WO2005/061156

PCT Pub. Date: Jul. 7, 2005

(65) Prior Publication Data

US 2007/0169912 A1 Jul. 26, 2007

(30) Foreign Application Priority Data

Dec. 19, 2003 (DE) ..... 103 60 694

(51) Int. Cl.

| | |
|---|---|
| ***B22C 9/02*** | (2006.01) |
| ***B22C 9/10*** | (2006.01) |
| ***B22C 25/00*** | (2006.01) |
| ***B22D 46/00*** | (2006.01) |

(52) U.S. Cl. ..... 164/456; 164/154.1; 164/323; 164/167

(58) Field of Classification Search ..... 164/456–457, 164/154.1, 323

See application file for complete search history.

(56) References Cited

U.S. PATENT DOCUMENTS

| | | | | |
|---|---|---|---|---|
| 5,069,267 | A * | 12/1991 | Larsen | 164/155.1 |
| 5,125,448 | A * | 6/1992 | Jensen | 164/155.1 |
| 5,921,312 | A * | 7/1999 | Carden | 164/369 |

FOREIGN PATENT DOCUMENTS

| | | | |
|---|---|---|---|
| DE | 30 23 685 | A1 | 1/1982 |
| DE | 199 49 500 | A1 | 4/2001 |
| GB | 2047140 | * | 11/1980 |
| JP | 09 314318 | A | 12/1997 |

* cited by examiner

*Primary Examiner*—Kuang Lin
(74) *Attorney, Agent, or Firm*—Proskauer Rose LLP

(57) ABSTRACT

The invention relates to a production line for the production of cast parts (M) from a metallic melt, in particular a light molten metal, which takes place in a continuous cycle, comprising a plurality of functional units, including a core production unit (2) for the production of casting cores, a mould assembly unit (3) for assembling casting moulds (G) formed as core packages, a casting unit for filling the molten metal into the casting moulds (G), a cooling unit (5*a*) for cooling the molten metal respectively contained in the casting moulds (G), and a demoulding unit (5*b*) for destructive removal of the casting mould (G) from the cast part (M). A production line of this type allows economical and flexible production of cast parts, in particular motor units, with a high loading capacity and complex form according to the invention in that the functional units (2 to 5*b*) successively passed through in each case are directly connected to each other by a respective conveying device (12, 19), and in that the cycle time with which the production line (1) ejects finished cast parts (M) is determined by the cycle time with which the core production unit (2) supplies the casting cores produced by the core production unit.

23 Claims, 1 Drawing Sheet

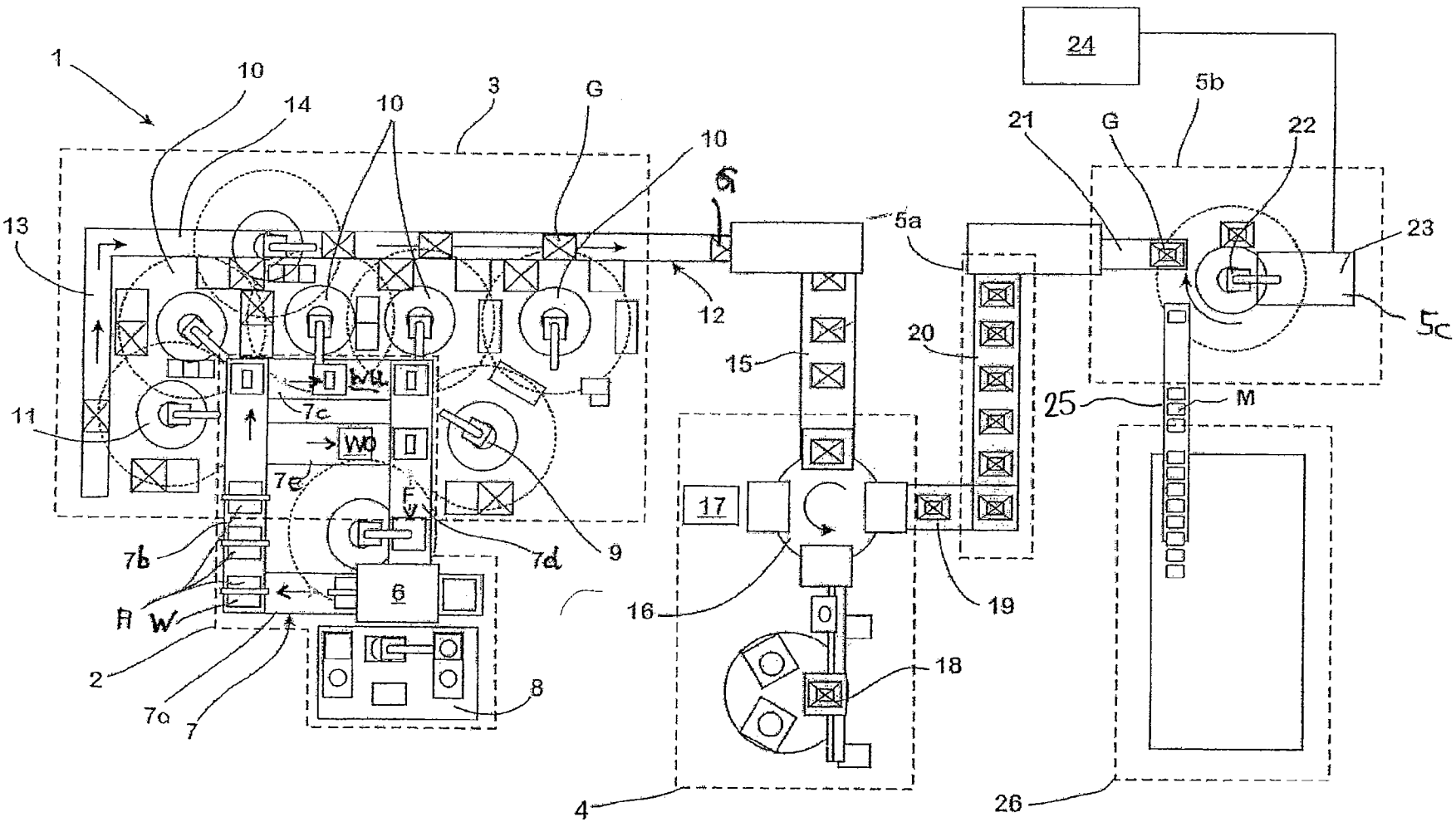
1
2
3
4
5a
5b
5c
6
7
7a
7b
7c
7d
7e
8
9
10
11
12
13
14
15
16
17
18
19
20
21
22
23
24
25
26
G
M
W

PRODUCTION LINE AND METHOD FOR THE PRODUCTION OF CAST PARTS, FROM A METALLIC MELT, IN PARTICULAR A LIGHT MOLTEN METAL, WHICH TAKES PLACE IN A CONTINUOUS CYCLE

CROSS-REFERENCE TO RELATED APPLICATIONS

This application is a National Phase Application of International Application No. PCT/EP2004/14388, filed on Dec. 17, 2004, which claims the benefit of and priority to German patent application no. DE 103 60 694.7, filed on Dec. 19, 2003. The disclosure of each of the above applications is incorporated herein by reference in their entirety.

FIELD OF THE INVENTION

The invention relates to a production line for the production of cast parts from a metallic melt, in particular a light molten metal, which takes place in a continuous cycle, comprising a plurality of functional units, including a core shooting and hardening unit for producing casting cores, a mould assembly unit for assembling casting moulds formed as core packages, a casting unit for filling the molten metal into the casting moulds, a cooling unit for solidifying the molten metal contained in the casting mould, a cooling unit for quenching in the context of a heat treatment, and a demoulding unit for destructive removal in good time of the casting mould from the cast part.

The invention also relates to a method for the production of cast parts from a molten metal, which takes place in a continuous cycle, wherein firstly casting cores are produced and then a casting mould, configured as a core package, is constructed from the casting cores. The molten metal is cast into this casting mould. The melt contained in the casting mould is subsequently cooled in a controlled manner at least until the cast part has solidified to a sufficient dimensional stability. Demoulding of the mould part can then begin, in which the casting mould is destroyed. The cast part is heat treated directly from the casting heat by quenching.

BACKGROUND OF THE INVENTION

Production lines and methods of the above indicated type are conventionally used in the large-scale series production of cast parts. The Applicant, for example, thus operates a production line with which motor units are cast in large numbers in an automated sequence in the described manner. In the known production line a number of core shooting machines are linearly linked together for this purpose. The number of core shooting machines required for this corresponds to the set of tools available in each case for a complete core package of a specific type of motor unit.

The shot and completely hardened cores are removed via removal palettes and assembled one after the other on an assembly line set up parallel to the core shooting machines to form a core package. To ensure the economic efficiency of a production line of this type cycle times of less than 60 seconds have to be adhered to with corresponding expenditure on automation.

A moulding material mixed from a known organic binder and a likewise conventional moulding sand is used in the known production line as the moulding material for producing the cores. This moulding material is compacted in what is referred to as the "cold box method" in which the organic binder is hardened by gassing with a reactive gas. The finished casting cores are assembled to form the casting moulds, temporarily stored in a storage device for gas evolution and subsequently mechanically tensioned together in the casting unit and cast.

After casting of the molten metal the respective casting mould is brought into a solidifying position, starting from which it passes cast part specifically in the pretensioned state through a cooling section for a period longer than 15 minutes. After solidification the casting moulds are loaded on palettes and moved into a heat treatment furnace. In this furnace the cast parts (motor units) are thermally desanded and solution treated in a process lasting several hours.

During thermal desandling the organic binder of the casting moulds is broken down at temperatures in the cast part that are just under the solidus temperature of the alloy used, so the sand casting mould disintegrates in rough fragments. As a result of further heating, mechanical conveying device and screening as well as the use of expensive sand coolers and bunkers the core shop is then supplied with fine-grain recycling sand again. Large quantities of sand and long conveying distances are required owing to the protracted thermal process.

An automated casting plant is also known from DE 40 16 112 C2, wherein a plurality of functional units are provided which are connected to a production line by intermediate conveyors.

Known production lines of the above described type allow motor units to be produced cost effectively in large numbers but are confronted by operating drawbacks which are particularly noticeable if smaller numbers are to be produced or the models of the parts to be cast frequently change. Thus greater technical expenditure caused by a number of machines and tools is required for core production. During a tool change, which becomes necessary following a change of model, the large number of complex machine units and the compulsion to run cycle times of less than 60 seconds entails long set-up times and complex assembly work which, in turn, cause availability losses. These losses induce low flexibility in the known production line as high set-up costs and, in the case of new products, additional investment costs stand in the way of quick adaptation to changed operating conditions or model types. All devices must be configured for it to be possible to achieve a short cycle time for each product.

The use of cores bound with organic binders also entails the problem that the tools used for producing the cores have to be cleaned outside of the core shop at regular intervals. Expensive exhaust air systems are also required to collect and purify the gases occurring during hardening of the cores in the "cold box method" and during thermal combustion.

These gases also lead to corresponding stresses on personnel. Casting defects can occur during the casting process as a result of gassing cold box cores.

A further drawback of the known production lines that entails high operating costs resides in the necessity of using a furnace with long treatment times for heat treatment and fettling, the furnace providing such high temperatures that the binder of the casting moulds is broken down and solution treatment is carried out at the same time. The flexibility with respect to a variation in the heat treatment parameters is severely limited by coupling to the thermal desanding.

The purely thermal desanding proves to be a problem in the case of sand adhesions (penetration, organic condensates), in particular in the inner channels of a motor unit.

High expenditure for the sand circulation owing to high sand temperatures, large quantities of sand, the necessity of cooling the sand to a defined temperature and the very high space requirement for the furnace additionally contribute to the fact that the known production lines may only be operated economically if the same motor units are produced in high numbers over a long production cycle. This economic efficiency consideration is opposed by the fact that the development times in the new construction of cast parts, in particular in the field of motor development, are becoming increasingly shorter and the changes in model accordingly becoming increasingly more frequent.

SUMMARY OF THE INVENTION

Starting from the above described prior art there was therefore a requirement to provide a production line and a method for producing cast parts from light metal, in particular aluminium-based alloys, which allow economical and flexible production of cast parts, in particular motor units, with a high loading capacity and with a complex form.

This object is achieved by a production line of the type mentioned at the outset wherein, according to the invention, the functional units successively passed through in each case are directly connected to each other by a respective conveying device, and wherein the cycle time with which the production line ejects finished cast parts is determined by the cycle time with which the core production unit supplies the casting cores produced by the core production unit.

In a corresponding manner the above-indicated object is achieved by a method for producing cast mould parts from a metal melt, in particular a light metal melt, wherein the following working steps are passed through in a continuous production sequence:

- shooting casting cores in a core tool from a moulding material mixed from a moulding basic material and a binder,
- hardening the casting cores in a core tool at stations of the core production unit,
- transferring the casting cores to a mould assembly unit,
- assembling the casting cores to form a casting mould formed as a core package,
- transferring the casting mould to a casting unit,
- controlled mould filling (casting) of molten metal into the casting mould,
- rotating the casting mould into the solidification position,
- transferring the casting mould filled with molten metal to a cooling unit,
- solidifying the molten metal contained in the casting mould,
- transferring the casting mould with the solidified cast part to a demoulding unit,
- demoulding the cast part with destruction of the casting mould in the demoulding unit,
- quenching the cast part from the casting heat,
- outputting the finished cast part,
- wherein the cycle time with which the finished cast parts are output is determined by the cycle time with which the casting cores are shot,
- processing and return of the moulding material into the core plant.

The invention provides a modular process chain in which the processing stations of core shop, core package assembly, casting, solidification, decoring and quenching for the respective cast part are passed through in a continuous sequence. The individual working stations are completed directly one after the other in the process. The term "directly" is not taken to mean the shortest spatial distance in this connection, rather according to the invention it is essential that the individual functional units are passed through one after the other without interruption. A production sequence takes place in which the individual working steps are directly linked together. Casting moulds and castings are conveyed through the production line in a continuous flow.

Intermediate stores or other storage devices, as are still unavoidable in the prior art, do not exist in a production line according to the invention. To achieve this, in a production line according to the invention the conveyor section, via which firstly the casting cores and then the casting moulds are conveyed, can obviously be guided such that an optimal working sequence is ensured irrespective of whether the respective parts are transported via the shortest distance to the respective next working station.

With the direct successiveness according to the invention of the individual functional units it is possible to carry out the process of cast part production from the core shop to demoulding of the casting "just in time" as a "one piece flow". In other words, in each case only the casting cores and casting moulds are produced which are currently required in the production line. The stockpiling of casting cores or casting moulds that is unavoidable in the prior art is dispensed with.

To ensure this "just in time" production, the cycle time of the production process according to the invention is determined by the most time-critical unit of production, namely core shooting. The hardening times are distributed among a plurality of stations in the core production plant.

It is thus ensured that a sufficient number of cores is always available from which core packages are then assembled as casting moulds without interruption. At the same time it is also ensured that there are, in turn, sufficient quantities in each case of molten metal for filling the casting moulds and that the capacity of the cooling unit for solidification, the demoulding unit and the quenching unit is sufficient in order, on the one hand, to in each case obtain a cast part that is faultless with respect to its structure and, on the other hand, to process the moulding material of the casting mould, occurring in each case as waste, and recycle it.

The cores output by the core production unit are taken over by the mould assembly device and assembled to form a core package. The cores respectively present at the transfer in the process form a set of casting cores from which a respective core package forming the respective casting mould can be assembled without particular sorting effort. Casting moulds may thus be assembled completely automatically without expensive controllers being required.

At the same time, as a result of the fact that the individual units of the production line are directly coupled to each other optimised conveyor sections are ensured which as a consequence contribute to a shortening of the total production time.

Cast parts, in particular motor units, with a high loading capacity and with a complex form may thus be economically produced with the invention without expensive devices and a high degree of complexity in terms of apparatus being necessary. At the same time, as a result of the fact that the casting moulds are constructed as core packages, changes in the model of the cast parts to be produced can be rapidly and flexibly reacted to as the cores are produced in a core production plant that can be easily changed.

A particularly preferred configuration of the invention provides that an inorganic, in particular a water glass-based, binder is used as the binder. In the event of exposure to heat, binders of this type ensure high dimensional stability of the cores after hardening. By using an inorganic binder it is thus possible to form the casting cores, which are subjected to relatively large specific loads in the core package forming the casting mould, so as to be thin walled. In addition, practical tests have shown that inorganically bound moulding materials can be easily disintegrated in water and exhibit good disintegration properties.

Core package casting moulds, which are constructed from cores produced by using inorganic binders, thus prove not only to be robust but have additional properties advantageous to the implementation of the method according to the invention.

Overall the core sand volume occurring in a production line according to the invention is reduced as decoring takes place in water shortly after casting and the casting mould can be constructed as a thin-walled core package with the said advantages.

The components required for holding and conveying the core package (fixing devices, chills, ingot moulds, supporting elements, fixing devices, etc.) can be easily cleaned and reused in a cycle.

The invention has proven to be particularly suitable in the production of motor units made of aluminium-based alloys and with a complex form.

An advantageous configuration of the invention is characterised in that the core production plant comprises a core shooting station, a plurality of hardening stations and a conveying device which conveys the core tools in a cycle from the shooting station, the hardening stations to the transfer stations to the mould assembly device and then back to the shooting station.

In a core production plant of this type the required tools (the number is dependent on the product) are conveyed onward in the cycle time by the conveying unit. The inward and outward conveying during tool changes can take place within the cycle time as only short distances have to be traversed. As a plurality of hardening stations are arranged along the conveyor section the cycle time is largely independent of the core size and hardening behaviour of the binder.

According to a further particularly practice-oriented configuration of the invention which assists the automatic production sequence, the core production unit comprises a device for automated changing of the shooting tops in the shooting station associated with the individual tools required for shooting of the cores.

In addition, automated tool cleaning is integrated. Core fracture can automatically be taken out at a position along the conveying unit.

Automatic moulding assembly in the mould assembly unit can be facilitated in that the finished cores are directly taken over at the take-over stations on the conveying unit of the core production plant.

The mould assembly unit used according to the invention in this case typically comprises more than one assembly station, and one conveying device successively conveys the respective casting mould to be produced to the assembly stations. Each of the assembly stations can perform a specific task and optionally has intermediate stores, core gluing stations, a liner supply, screwing devices, etc.

This allows relatively simple robots adapted to a specific assembly sequence to be used for assembling the casting moulds.

If additional components are to be cast into the molten metal, such as cylinder inserts (liners) or bearing block reinforcements, then it is advantageous if the production line comprises a heating device for heating these components to be cast into the cast part. It is advantageous for the desired continuity of the production sequence if the heating device is integrated into the casting unit and heating takes place in plant cycle time.

As heating takes place directly before controlled mould filling (casting) the risk of uncontrolled cooling is reduced to a minimum. The temperature of the components to be cast can be purposefully adjusted with low expenditure of energy and be coordinated with the mould filling and solidification sequence of the entire cast part.

This may be simply achieved in particular if the heating device operates inductively.

The casting unit can be incorporated into the cycle time predetermined by the core production unit in that the casting unit comprises a rotary table which takes over the respective casting mould conveyed from the mould assembly unit to the casting unit at a transfer station of the conveying device connecting the mould assembly unit to the casting unit, conveys the casting mould in a pivoting movement to a casting station, and after filling the casting mould with melt in a controlled manner in the casting station, conveys the casting mould onward to a transfer station at which it transfers the respective casting mould to the conveying device leading to the cooling unit.

The mould can be filled in a controlled manner by coupling the casting moulds to a known low-pressure casting furnace, gas pressure-controlled melt conveying into the mould cavity, sealing of the filling port and subsequent 180° rotation into the solidification position (roll-over). Alternatively, the rotary movement can be used to control the mould filling operation.

A particular advantage in core packages made of inorganic binders is that gases are hardly produced on contact with the melt as the binders do not burn.

If necessary local chills may be used to purposefully dissipate heat from the region of apertures, bearing blocks, accumulations of material, etc.

The solution treatment, which can only be carried out in the prior art with considerable expense, can be avoided in that, starting from a specific temperature, the castings are quenched. To make this possible a further configuration of the invention provides that the cooling unit comprises a quenching station for quenching the cast part from the casting heat.

The solidified cast part can be decored in a manner known per se by liquid jets. For this purpose, the demoulding unit preferably comprises a liquid jet device for destroying the casting mould. The casting cores located in the cast part can also be washed out using a liquid jet device of this type.

The demoulding unit can also comprise a basin that can be filled with liquid and into which the casting mould can be inserted. As the casting mould with the casting is moved in the liquid, or water jet nozzles are arranged in the basin, disintegration of the casting mould may be accelerated. For this purpose, a movement device for moving the casting mould immersed into the basin may be associated with the liquid basin. The cast mould parts collected in the liquid disintegrate further into fine grained moulding material and may be easily removed from the liquid basin.

Water, optionally with additives, which can be heated to a specific temperature that additionally assists the disintegration of the moulding material of the casting mould, is particularly suitable as the liquid for destroying the casting mould and washing out the moulding material.

A particularly practice-oriented configuration of the invention is characterised in that the cooling unit and the demoulding unit are united to form a combined cooling and demoulding unit.

The problems caused in the prior art owing to the use of organic binders may be eliminated in that an inorganic binder is used as the binder of the moulding material. Binder systems of this type known per se from the prior art may be hardened by heating without gases that burden the environment or the machine personnel occurring.

DETAILED DESCRIPTION OF THE INVENTION

The invention will be described in more detail hereinafter with reference to an embodiment.

The single FIGURE schematically and in plan view shows a production line 1 for fully automated production of motor units made of an aluminium alloy. The production line comprises a core production unit 2 for producing casting cores, a mould assembly unit 3 for assembling casting moulds G formed as core packages, a casting unit 4 for filling aluminium melt into the casting moulds G, a cooling unit 5*a* for solidifying the molten metal contained in the casting mould G and a demoulding unit 5*b* for destructive removal of the respective casting mould G and a quenching unit 5*c* of the cast part M.

The core production unit 2 comprises a core shooting station 6 and a transporting device 7 constructed as a conveyor section. The transporting device 7 is divided into four sections 7*a*, 7*b*, 7*c* and 7*d* which are arranged at a right angle to each other such that, in plan view, they form the side line of a rectangle. The upper parts WO of the core tool can be conveyed to section 7*d* via a conveyor section 7*e* arranged parallel to the shorter sections 7*a*, 7*c*. The core shooting station 6 is positioned in a corner region of the transporting device 7 at which sections 7*a* and 7*d* of the conveying device meet. Casting cores made of moulding material mixed from an inorganic binder and silica sand or synthetic sand are shot in the core shooting station 6 in a manner known per se.

A shooting top changing device 8 is associated with the core shooting station 6 and provides the shooting top respectively used in the core shooting station 6 in a tool-specific manner.

The tools W are positioned in the hardening stations A for hardening the cores by exposure to heat and purging air. The upper parts WO of the tool are raised in the centre of section 7*b* and passed to the conveyor section 7*e*.

A first assembly robot 11, which takes over cores, issuing from the hardening station A and conveyed via the section 7*b*, from the lower part WU of the tool, is subsequently associated with the mould assembly unit 3.

Further assembly robots 10 of the mould assembly unit 3 corresponding to the take-over robot 11 are positioned along section 7*c*, arranged opposite section 7*a*, of the transporting device 7. A final assembly robot 9 of the assembly unit 3 is positioned at the start of section 7*d* opposite section 7*b* in the conveying direction F. Transfer stations at which the finished casting cores are transferred to the mould assembly unit 3 are thus formed at sections 7*b*, 7*c* and 7*d* of the transporting device 7. The assembly robots 9 to 11, forming a respective assembly station, of the mould assembly unit 3 assemble casting moulds G formed as core packages from the respective casting cores taken over by them.

The casting moulds G are conveyed via a conveying device 12 formed as a conveyor section along the assembly robots 9 to 11. The conveying device 12 comprises three linearly extending sections 13, 14, 15, of which, in plan view, the first section 13 is arranged at a right angle to the second section 14 and the third section 15 is, in turn, arranged at a right angle to the second section 15, so the sections 13 to 15 are arranged in the manner of a U in plan view.

The first casting cores of the respective casting mould G are assembled on the first section 13 of the conveying device 12 by the first assembly robot 11. Then, in this state, partially completely constructed casting moulds G subsequently arrive at section 14 of the conveying device 12 and are conveyed along this to the assembly robots 10, 9 which in each case add further casting cores G to the respective casting mould until, on leaving the mould assembly unit 3, the casting mould is completely assembled.

From section 14 of the conveying device 12 the casting moulds G arrive at section 15 which guides them to a rotary table 16. The rotary table 16 takes over the respective casting mould G and conveys it in a 90° rotation to a heating station 17 in which inserts (for example liners, etc.), chill mould parts (for example brass sleeves for aperture region, etc.) to be cast into the motor unit to be produced are inductively heated.

As a result of a further 90° rotation of the rotary table 16 the casting mould G is conveyed to the casting station 18 of the casting unit 4. There the aluminium melt is conveyed into the respective casting mould G. The rotary table 16 subsequently again conveys the casting mould G filled with melt to a transfer station at which the casting mould G is transferred to a further conveying device 19 formed as a conveyor section.

During cooling the casting mould G is conveyed onward via a straight-line conveyor section 20 of the cooling unit 5*a*. At the end of the conveyor section 20 the solidification of the aluminium melt in the casting mould G is concluded to the extent that the cast part M formed therein has obtained a solid form.

From the exit of the cooling unit 5*a* the casting mould G, which still has its original shape, is conveyed via a conveying device 21, likewise constructed as a conveyor section and arranged at a right angle to the conveyor section 20 of the cooling unit 5*a*, to a take-over station of the demoulding unit 5*b*. There a casting mould manipulator (robot) 22 takes over the respective casting mould G and immerses it in a water basin 23.

The casting mould G is moved in the water basin 23 filled with heated water in order to speed up initiation of its disintegration. In addition, the casting mould G can be destroyed in an accelerated manner by water jet devices (not shown) and cores located in the interior of the solidified cast part M can be washed out.

The fragments of the casting mould G are collected in the water basin 23 and disintegrate as the inorganic binder dissolves in the water basin 23. In the process fine grained moulding basic material accumulates. The moulding basic material is mixed with new inorganic binder to form a new moulding material again and is supplied to the core production unit 2 again.

The inorganic binder on the other hand is partially dissolved in the water of the water basin 23. The water containing the binder is also supplied to a processing stage and returned into the production cycle.

After demoulding the cast part (motor block) M that is now free of casting core residues is supplied via a conveyor section 25 to a finishing unit 26 in which it is deburred, sawn and if necessary subjected to further finishing operations.

The cycle time with which the cast parts M are ejected from the production line 1 is determined by the cycle time with which the core production unit 2 supplies the casting cores produced by it to the mould assembly unit 3. Owing to the direct linking of units 2 to 6, the rapid cooling and the fettling directly combined with cooling, only a small number of cast part manipulators (robots) are required for conveying the cast parts and their treatment in these individual functional units 2 to 6 of the production line 1. This also leads to the production line according to the invention being able to produce high quality cast parts in relatively small numbers particularly economically with machines with a low degree of complexity and low costs.

LIST OF REFERENCE NUMERALS

1 Production line
2 Core production unit
3 Mould assembly unit
4 Casting unit
5*a* Cooling unit
5*b* Demoulding unit
5*c* Quenching unit
6 Core shooting station
7 Transporting device
7*a* to 7*d* Sections of the transporting device
8 Shooting top changing device
9 to 11 Assembly robots
12 Conveying device
13 to 15 Sections of the conveying device 12
16 Rotary table
17 Heating station (inductive)
18 Casting station of casting unit 4
19 Conveying device
20 Conveyor section of cooling unit 5*a*
21 Conveying device
22 Casting mould manipulator of demoulding unit 5*b*
23 Water basin of demoulding unit 5*b*
24 Processing unit
25 Conveyor section
26 Finishing unit
F Conveying direction of transporting device 7
G Casting moulds
M Cast parts
W Core tools
WO Upper part of core tool
WU Lower part of core tool
A Hardening station

The invention claimed is:

1. Production line for the production of cast parts from a metallic melt, which takes place in a continuous cycle, comprising a plurality of functional units, including a core production unit for the production of casting cores, a mould assembly unit for assembling casting moulds formed as core packages, a casting unit for filling molten metal into the casting moulds, a cooling unit for cooling the molten metal respectively contained in the casting moulds, and a demoulding unit for destructive removal of the casting mould from a cast part, wherein the functional units successively passed through in each case are directly connected to each other by a respective conveying device, wherein the functional units are completed directly without interruption in a continuous flow and a first cycle time with which the finished cast parts are output is determined by a second cycle time with which the casting cores are produced.

2. Production line according to claim 1, wherein the core production unit comprises a transfer station for transferring finished cores to the mould assembly unit and a conveying device which conveys core shooting tools in a cycle from the transfer station to a core shooting station and then back to the transfer station.

3. Production line according to claim 2, wherein the conveying device is constructed as a conveyor section, and the core production unit comprises more than one hardening station arranged along the conveyor section.

4. Production line according to claim 1, wherein the core production unit comprises a device for automated changing of the product-specific core tools required for shooting the casting cores, and in that a third cycle time with which the change takes place is coupled to the second cycle time with which the core production unit supplies the casting cores produced by the core production unit.

5. Production line according to claim 1, wherein the mould assembly unit comprises a take-over station with which the mould assembly unit takes over finished cores output by the core production device, and a conveying device which successively conveys the casting mould to be finished to the assembly stations.

6. Production line according to claim 5, wherein the mould assembly unit comprises more than one assembly station, and in that the conveying device successively conveys the respective casting mould to be finished to the more than one assembly stations.

7. Production line according to claim 1 further comprising a heating device for heating components to be cast into the cast part.

8. Production line according to claim 7, wherein the heating device is integrated into the casting unit and the casting mould passes though the heating device in a fourth cycle time with the mould elements inserted in the casting mould.

9. Production line according to claim 7, wherein the heating device operates inductively.

10. Production line according to claim 1, wherein the casting unit comprises a rotary table which takes over the respective casting mould conveyed from the mould assembly unit to the casting unit at a first transfer station of the conveying device connecting the mould assembly unit to the casting unit, conveys the casting mould in a pivoting movement to a casting station, and after filling of the casting mould with melt in a controlled manner in the casting station, rotates the casting mould into a solidifying position and conveys the casting mould onward to a second transfer station at which the second transfer station transfers the respective casting mould to the conveying device leading to the cooling unit.

11. Production line according to claim 1, wherein the cooling unit has a quenching station for quenching the cast part from a casting heat.

12. Production line according to claim 1, wherein the demoulding unit comprises a liquid jet device for destroying the casting mould.

13. Production line according to claim 12, wherein the liquid jet device is intended for washing the casting cores out of the cast part.

14. Production line according to claim 1, wherein the demoulding unit comprises a basin that can be filled with liquid and into which the casting mould can be inserted.

15. Production line according to claim 14, wherein a movement device for moving the casting mould immersed in the basin is associated with the liquid basin.

16. Production line according to claim 1, wherein the cooling unit and the demoulding unit are united to form a combined quenching and demoulding unit.

17. Method for automatically producing cast mould parts from a molten metal, wherein the following working steps are passed though in a continuous production sequence:

producing casting cores in a core production unit from a moulding material mixed from moulding basic material and a binder;

transferring the casting cores to a mould assembly unit;

assembling the casting cores to form a casting mould formed as a core package;

transferring the casting mould to a casting unit;

controlled mould filling of molten metal into the casting mould;

transferring the casting mould filled with molten metal to a cooling unit;

cooling the molten metal contained in the casting mould;

transferring the casting mould with a cooled cast part to a demoulding unit;

demoulding the cast part with destruction of the casting mould in the demoulding unit;

quenching the cast part from a casting heat; and outputting a finished cast part wherein the functional units are completed directly without interruption in a continuous flow and a first cycle time with which the finished cast parts are output is determined by a second cycle time with which the casting cores are produced.

18. Method according to claim 17, wherein the binder of the moulding material is an inorganic binder.

19. Method according to claim 17, wherein the respective transfer comprises conveying from one unit to the next unit.

20. Method according to claim 17, wherein, in the course of cooling, the casting mould is immersed in a basin filled with coolant.

21. Method according to claim 20, wherein a strong relative movement is generated between casting mould and coolant.

22. Method according to claim 17, wherein the casting is demoulded by means of a liquid which removes cohesion of the moulding material.

23. Method according to claim 22, wherein the moulding material detached by the liquid is collected and supplied to a processing stage.

* * * * *